US005555635A

United States Patent [19]

Seidl

[11] Patent Number: 5,555,635

[45] Date of Patent: Sep. 17, 1996

[54] CONTROL AND ARRANGEMENT OF A CONTINUOUS PROCESS FOR AN INDUSTRIAL DRYER

[75] Inventor: Paul G. Seidl, De Pere, Wis.

[73] Assignee: W. R. Grace & Co.-Conn., New York, N.Y.

[21] Appl. No.: 374,015

[22] Filed: Jan. 18, 1995

[51] Int. Cl.[6] ..... F26B 21/06

[52] U.S. Cl. ..... 34/79; 34/634; 34/640; 34/643

[58] Field of Search ..... 34/79, 83, 619–21, 34/634–36, 638, 641, 649, 651, 640, 643, 414

[56] References Cited

U.S. PATENT DOCUMENTS

| | | | |
|---|---|---|---|
| 3,638,330 | 2/1972 | Stout | 34/643 |
| 4,116,620 | 9/1978 | Stibbe | 34/638 |
| 4,133,636 | 1/1979 | Flynn | 34/636 |
| 4,406,388 | 9/1983 | Takashi et al. | 34/640 |
| 4,601,116 | 7/1986 | Krimsky | 34/641 |
| 4,606,137 | 8/1986 | Whipple | 34/634 |
| 4,622,761 | 11/1986 | Barth | 34/634 |
| 5,038,495 | 8/1991 | Jacobs et al. | 34/62 |
| 5,054,212 | 10/1991 | Ishikawa | 34/634 |
| 5,333,395 | 8/1994 | Bulcsu | 34/79 |
| 5,351,416 | 10/1994 | Witkin | 34/79 |

FOREIGN PATENT DOCUMENTS

| | | |
|---|---|---|
| 714114 | 9/1996 | Russian Federation . |
| 760188 | 10/1956 | United Kingdom . |

*Primary Examiner*—John M. Sollecito
*Assistant Examiner*—Steve Gravini
*Attorney, Agent, or Firm*—Craig K. Leon; William L. Baker; Kevin S. Lemack

[57] ABSTRACT

Flotation drying apparatus for the staged (indirect) heating of solvent laden air recirculating within a drying enclosure, and a method of optimally controlling and directing solvent laden recirculation air such that condensation and sapping of solvent and various solvent-based by-products may be effectively reduced or eliminated. In addition to the reduction of condensate, a greater and more uniform mixing of the atmosphere within the drying enclosure is achieved, thereby enhancing safety and the drying process as pockets of high concentration solvent vapors are reduced. Air from outside the dryer enclosure is heated within the dryer enclosure, and is mixed with solvent-laden air. The mixed air is recirculated to the first drying zone of the dryer.

17 Claims, 4 Drawing Sheets

CONTROL AND ARRANGEMENT OF A CONTINUOUS PROCESS FOR AN INDUSTRIAL DRYER

BACKGROUND OF THE INVENTION

The present invention relates to web supporting and drying apparatus. In drying a moving web of material, such as paper, film or other sheet material, it is often desirable that the web be contactlessly supported during the drying operation, in order to avoid damage to the web itself or to any ink or coating on the web surface. A conventional arrangement for contactlessly supporting and drying a moving web includes upper and lower sets of air bars extending along a substantially horizontal stretch of the web. Heated air issuing from the air bars floatingly supports the web and expedites web drying. The air bar array is typically inside a dryer housing which can be maintained at a slightly subatmospheric pressure by an exhaust blower that draws off the volatiles emanating from the web as a result of the drying of the ink thereon, for example. The exhausted gases can then be treated to oxidize any volatile components, and the resulting clean gases can then be released to atmosphere.

Temperatures sufficient to fully oxidize the volatiles (typically in the 1250° F. to 1500° F. (675° C.–815° C.) range) are not reached in dryers of this type. Nor is sufficient residence time or mixing provided to cleanly treat the volatiles, for example. Indeed, it is desirable to avoid, or mitigate to the greatest extent possible, the partial oxidation and cracking of the volatiles, as partially oxidized and cracked compounds are often more deleterious than volatile material which has undergone little or no decomposition. The former may result from incomplete combustion due to insufficient oxygen, arrested combustion or insufficient temperature and length of time for the reaction to be completed, resulting in the generation of soot, carbon black, aldehydes, organic acids and carbon monoxide. The condensation and formation of the solids of these unwanted compounds on the internal surfaces of the drying apparatus are undesirable, as high accumulations may contaminate the web and product, may eventually adversely affect the operation of the dryer, and may present a fire hazard.

Additionally, it is desirable to provide make-up air to the dryer in such a way that internal surfaces are not unduly cooled, thus causing sites for the formation of condensation and solids of incomplete combustion.

It is therefore an object of the present invention to mitigate condensation and sapping of solvent and solvent-based by-products in an industrial dryer.

It is a further object of the present invention to provide for more thorough mixing of dryer atmosphere in order to maintain even solvent concentrations throughout the dryer enclosure.

SUMMARY OF THE INVENTION

The problems of the prior art have been overcome by the present invention, which provides staged (indirect) heating of solvent laden air recirculating within a drying enclosure, and a method of optimally controlling and directing solvent laden recirculation air such that condensation and sapping of solvent and various solvent-based by-products may be effectively reduced or eliminated. In addition to the reduction of condensate, a greater and more uniform mixing of the atmosphere within the drying enclosure is achieved, thereby enhancing safety and the drying process as pockets of high concentration solvent vapors are reduced.

DETAILED DESCRIPTION OF THE INVENTION

Figure 1:
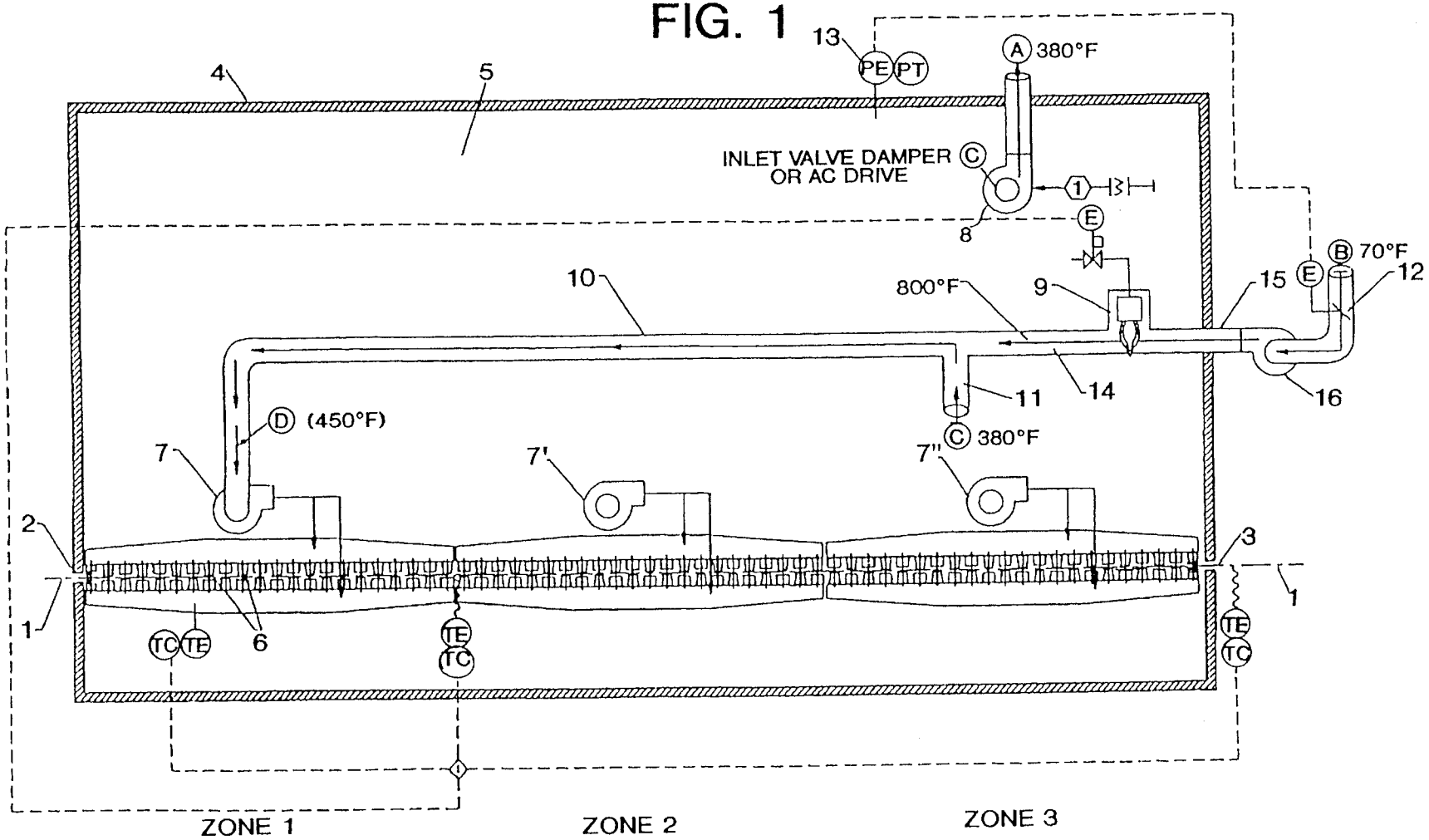
FIG. 1 is a schematic representation of a dryer having staged (indirect) heating in accordance with the present invention.

Turning now to FIG. 1, an embodiment of the drying process in accordance with the present invention has an enclosure 4 of gas- tight construction, the enclosure 4 having an inlet slot 2 and an exit slot 3 spaced from said inlet slot 2, through which a moving, continuous web of material 1 enters and exits respectively. Said web of material 1 is floatingly supported continuously through the dryer by a series of upper and lower air jet nozzles 6. For optimum heat transfer characteristics, the jet nozzles 6 preferably include Coanda-type flotation nozzles such as the HI-FLOAT® air bar commercially available from W. R. Grace & Co.-Conn., as well as direct impingement nozzles such as hole bars. Preferably each direct impingement nozzle is positioned opposite a Coanda-type air flotation nozzle. The air jet nozzles 6 are provided with high pressure gas through a direct connection to supply fans 7, 7' and 7". It is important to note that dryers of this type and duty are often considered to be comprised of zones which are, in turn, demarcated by the influence of one or more supply fans. And as such, the intensity of the drying of the web of material is directly related to the magnitude of the temperature and velocity of the gas emitted by the jet nozzles directly connected to supply fans, and thus the real drying rate may vary from zone to zone. In accordance with the present invention, there may exist from one to any plurality of zones with no need for physical walls or barriers to separate the zones. FIG. 1, as an example, has three zones: a first zone (zone 1), a middle zone (zone 2) and a leaving zone (zone 3).

As the web of material 1 travels through the dryer 4, the volatile components of the coating on the web 1, such as solvents from ink, evaporate and are absorbed into the internal dryer atmosphere 5. To prevent dangerous concentrations of solvent vapor from accumulating within the enclosure 4, an exhaust fan 8 is employed to extract internal gases at a rate sufficient to maintain acceptably safe concentrations of volatile vapors. To make up for the gases extracted, atmospheric air (at approximately 70° F.) free of all volatile material is allowed into the dryer enclosure 4 through make-up air opening 15. The mass flow rate of clean air allowed into the enclosure 4 is controlled via a pressure sensing device 13 which monitors and controls the static pressure within the dryer enclosure 4 to an operator determined set point. A slight negative static gauge pressure,–0.25 mbar to −1.25 mbar for example, is maintained within the enclosure 4 to minimize or prevent vapors from escaping through inlet slot opening 2 and outlet slot opening 3. The pressure sensing device 13, through a controller, manipulates, for example, a make-up air damper 12 which controls the amount of air that enters the enclosure 4 through opening 15. Alternatively, a variable speed fan could be used instead of the damper 12 to perform this function. FIG. 1 also includes, for example, a make-up air fan 16 which draws fresh air through the make-up damper 12 and pushes the air into the enclosure 4 and into burner tube 14. The burner tube 14 houses the burner 9, which in this embodiment is preferably a raw gas type burner. Sufficient air supply (secondary air) is forced around and through flame front to support combustion. The burner tube 14 is sealed air-tight to make-up air damper 12 and the ambient surroundings and thus only clean air is allowed to pass through the burner tube 14 and have contact with burner flames; solvent laden air is not exposed to the burner or burner flame. The resulting heated, clean makeup air exits the burner tube 14 at a temperature of about 800° F. and is mixed with solvent laden dryer atmosphere air (having a temperature of about 380° F.) in mixing channel 10. Dryer atmosphere air enters the mixing channel 10 via the recirculation duct 11.

In this way, volatiles in the form of vapors that are present in the dryer enclosure 4 never have direct contact with the burner 9 or burner flame. This greatly reduces the formation of intermediate compounds that are created by partial oxidation and which may condense in various forms on cool surfaces within the dryer enclosure 4. Also, because the clean make-up air, which is at an ambient temperature of usually 68°–85° F., is heated immediately without contact with internal surfaces or volatiles, the incidence of condensation in the dryer enclosure is significantly reduced. The mixing channel 10 is under negative gauge pressure since it is ducted air-tight to the inlet side of supply fan 7. The heated air mixture exiting the mixing channel 10 (having a temperature of about 450° F.) is then distributed by supply fan 7 through the jet nozzles 6 of this zone.

The air mixture mass flow rate requirement D of the supply fan 7, connected to the mixing channel 10, must be greater than the clean air mass flow rate B that is required as make-up air. If the enclosure 4 is gas-tight and air infiltration through the inlet and outlet slot openings 2, 3 is considered to be negligible, then the make-up air rate B is essentially equal to the exhaust rate A. The mass flow rate requirement D is then equal to the combined mass flow rates of fresh make-up air B and dryer atmosphere air C. The flow pattern within the dryer enclosure 4 is thus established: a controlled mass flow rate of solvent laden air A is exhausted from the leaving end or last zone of a heating dryer. An equal amount of fresh make-up air B enters the enclosure and is heated by a burner 9 and is separately mixed with dryer atmosphere air C which is also extracted from the leaving end or last zone of the dryer. The heated fresh air and solvent laden dryer atmosphere is then transported to the entering end or first zone of the heating dryer. The air mixture is then discharged through the jet nozzles 6 of this zone and impinges directly on the web of material 1. This mixture of air is evenly distributed throughout zone 1. Since there is no provision made for recirculation of this air mixture directly back to the supply fan 7 of zone 1, all of the air discharged from the jet nozzles of this zone must cascade or traverse into the next zone (zone 2). The air mixture from zone 1 then is mixed with air that is discharged from the jet nozzles of zone 2. A portion of this mixture is recirculated into the supply fan 7' of zone 2 while the balance is cascaded to the next zone (zone 3). Because the exhaust fan 8 and the recirculation duct 11 are in the last zone of the dryer, a mass flow rate of air equal to D cascades through the entire dryer. Additionally, all clean air that is introduced to dryer atmosphere 5 is available immediately at the entering end (zone 1) of the dryer and then throughout the entire dryer as it cascades toward the leaving end or last zone.

In typical operation, the web of material 1 coated with volatile containing materials is heated to volatilization of these materials in zone 1 with only a small amount of volatiles being released. As the web of material 1 travels further into the dryer, volatiles are evaporated at an increasing rate. Thus, it can be expected that the greatest concentration of volatile vapors may accumulate in the latter zones of a dryer or in the zone to which the exhaust fan may draw them. Since a high concentration of volatile vapors may present an unsafe condition and impede the drying phenomenon due to high vapor pressures in the convection air currents, it is advantageous to prevent areas of high concentrations from forming. As it is expected that high concentrations may accumulate in the leaving end of the dryer, a portion of this air mixture is extracted via recirculation duct 11, mixed with clean air, and then distributed in the first zone where volatile concentrations are typically the lowest.

Therefore, the combined redistribution of high concentration air from the last zone to the first, together with the cascade effect of all available clean air through the dryer, provides for a more safe environment within the dryer enclosure 4. Moreover, the staged (indirect) heating of the dryer atmosphere by heating clean make-up air greatly reduces the likelihood of volatiles condensation, since no volatile vapors contact the cool make-up air or any surfaces that may be cooled by the clean make-up air entering the dryer enclosure 4 at ambient temperatures.

Figure 2:
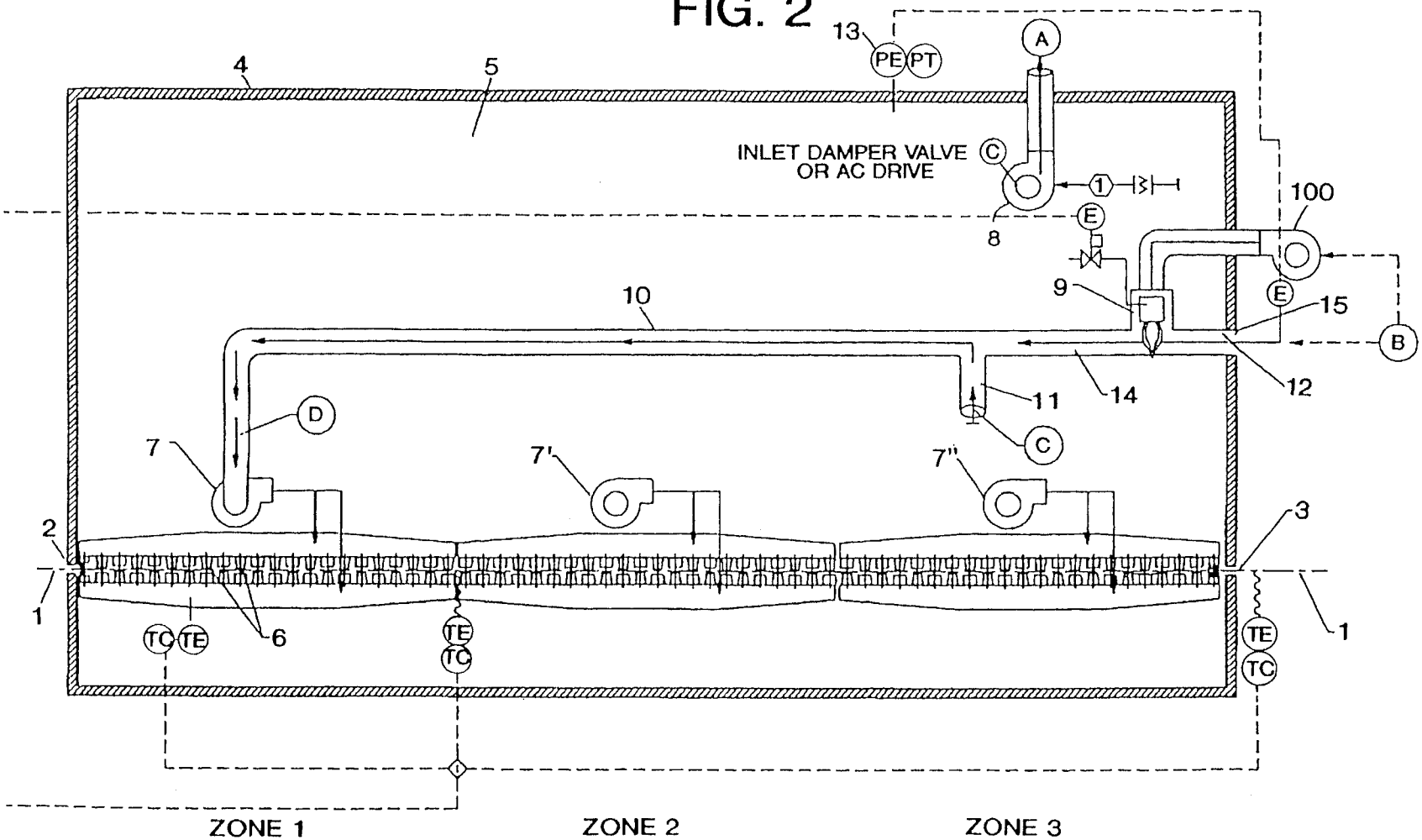
FIG. 2 is a schematic representation of a dryer having staged (indirect) heating in accordance with an alternative embodiment of the present invention.

FIG. 2 depicts an alternative embodiment of the present invention, wherein fan 16 of FIG. 1 is eliminated. Burner 91 is preferably a nozzle mix type burner, receiving clean, ambient combustion air (primary air) via a combustion blower 100 at a nearly constant rate. The combustion air mixes with burner fuel through the burner nozzle just prior to combustion. Damper 121 controls the mass flow rate of clean, ambient make-up air (secondary air) flowing to burner 9. Both the primary air from the combustion blower and the secondary air (supplied through damper 121) are together considered make-up air. However, the control is separate in that the primary air supplied by the combustion blower 100 is controlled according to the firing rate of the burner, whereas the secondary air is controlled via the make-up air damper 121, which in turn is controlled by the pressure sensor/controller 13 which controls the pressure in the dryer enclosure. The remainder of the flow patterns within the dryer are the same as with the embodiment of FIG. 1.

Figure 3:
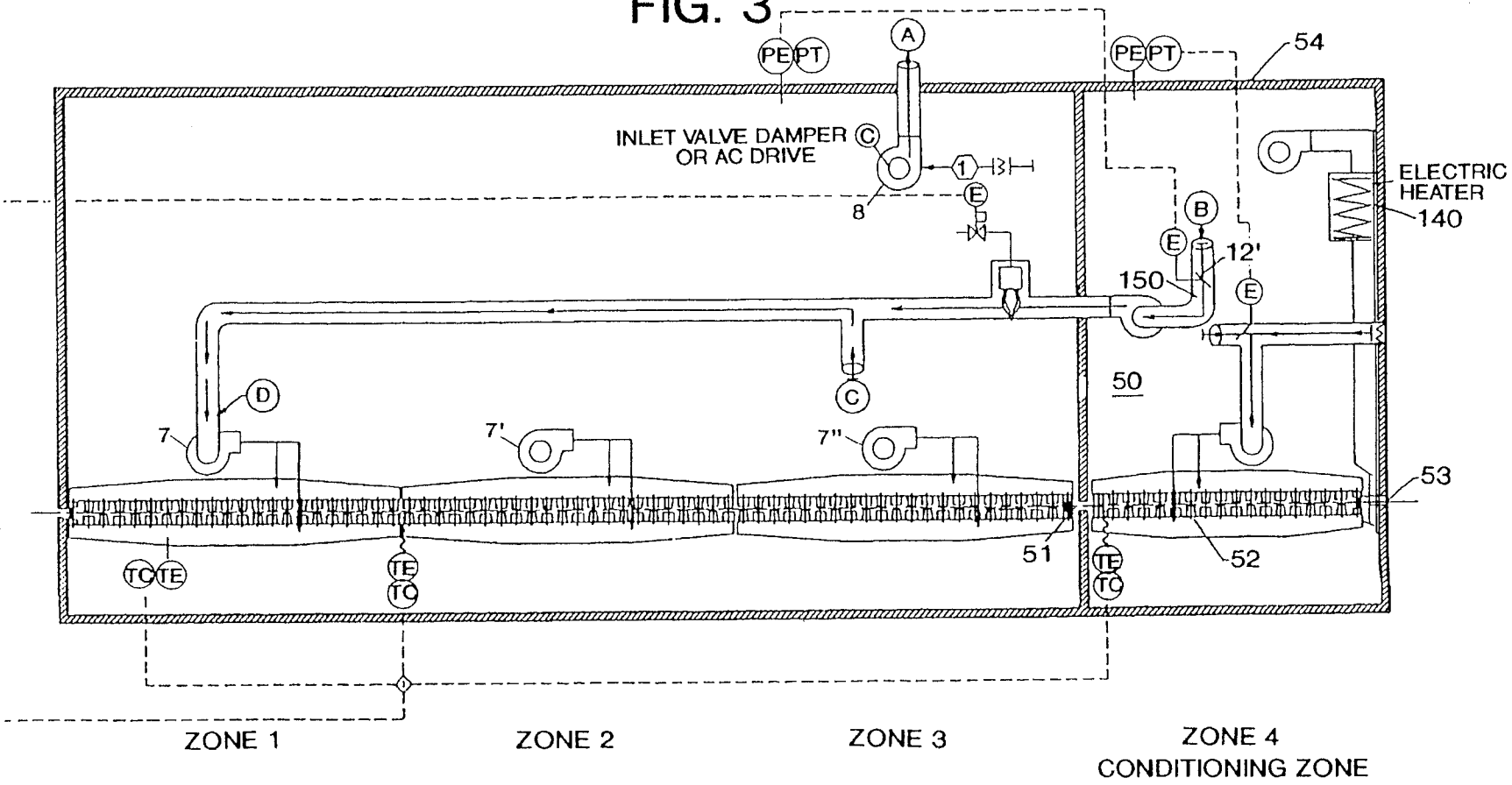
FIG. 3 is a schematic representation of the dryer of FIG. 1, with the addition of a fully integrated conditioning zone.

Turning now to FIG. 3, there is shown a dryer similar to the dryer of FIG. 1, with the addition of a conditioning zone 50 fully integrated therewith. The web 1 enters the conditioning zone enclosure 50 via a conditioning zone enclosure opening 51. The web 1 is supported in the zone 50 by a series of additional air jet nozzles 52, preferably a combination of Coanda-type air bars and direct impingement nozzles oppositely opposed, and finally exits the conditioning zone 50 via opening 53. Preferably the conditioning zone enclosure 50 is contained and fully integrated within the dryer enclosure 4, and is maintained gas tight and thermally insulated from the dryer enclosure 4 via an insulated wall 54. A pair of opposed gas seal nozzles can be positioned on both sides of the entering end opening 51 in the insulated wall 54 of the conditioning zone 50. Although any type of air nozzle that can effectively direct air so as to prevent unwanted gas flow through the opening 51 can be used as the gas seal nozzles, preferably the gas seal nozzles on the dryer side are conventional air knives capable of delivering air at a velocity of from about 6000 to about 8500 feet per minute, and preferably the gas seal nozzles on the conditioning zone side are conventional air foils capable of delivering air at a velocity of about 1000 to about 4500 feet per minute, both commercially available from W. R. Grace & Co.-Conn. The dryer side gas seal nozzles force dryer atmosphere air counter to the direction of travel of the strip of material 1, and the conditioning zone side gas seal nozzles force conditioning zone atmosphere air counter to the direction of travel of the strip of material 1. The pair of opposing gas seal nozzles are sealed to the conditioning zone insulated wall 54 with gasket seals, such that any differential pressure that may exist from the dryer enclosure 4 atmosphere to the conditioning zone 50 atmosphere will not cause an unwanted flow of gases through the opening 51. This gas seal arrangement is especially important in preventing solvent vapors from entering the conditioning zone 50 from the dryer 4 through opening 51. Specifically, the control and prevention of unwanted gas flow through the opening 51 is achieved by the directionality of the air jets of the gas seal nozzles. The air knives produce a very distinct, high velocity, high mass flow discharge of gas in a direction counter to the direction of travel of the strip of material 1, and thus cause a bulk movement of dryer atmosphere air away from the opening 51 and the conditioning zone enclosure 50. This constitutes a major portion of the sealing against flows due to possible differential pressure states and/or discharges from the adjoining jet nozzles. To further reduce the flow of solvent vapors into the conditioning zone enclosure, conditioning zone side gas seal nozzles produce a discharge of relatively clean air, as is controlled within the conditioning zone enclosure 50, and again, in a direction counter to the direction of travel of the strip of material 1. This clean air discharge has a low solvent vapor pressure and thus readily mixes with the thermal boundary layer of air on the surface of the strip of material 1, which is of relatively high solvent vapor pressure. The counter flow of this mixture effectively scrubs solvent vapors from the strip of material, preventing entrance to the conditioning enclosure 50 by way of induced flow in the opposite direction into the dryer enclosure 4.

Since the air that is drawn into the conditioning zone 50 is relatively cool ambient air, and since this air is directly discharged onto the strip of material 1 via the air jets in the conditioning zone 50, the hot strip of material 1 is cooled. The heat from the strip of material 1 is absorbed by the discharged air and is drawn out of the conditioning zone 50 via duct 150 having damper 12' and into the burner 9.

In order to further control and prevent solvent condensation within the conditioning zone enclosure, a heat gas seal (not shown) may be provided just prior to the exit end opening 53. Any suitable nozzles can be used to provide the thermal gas seal, as long as they fulfill the requirement of providing an even, low velocity discharge of hot air into the cold air stream flow that enters the enclosure as infiltration air through exit end opening 53. The discharge velocity of the thermal gas seal nozzles is from about 0 to about 6000 feet per minute, depending upon temperature requirements. The nozzles are mechanically sealed to the conditioning zone exit wall using suitable gaskets. Hot air provided to this gas seal is controlled via a gas seal damper. The hot air from this gas seal is free of solvent vapors and provides temperature control of the atmosphere within the conditioning zone 50. Hot air expelled from the gas seal is directed into the conditioning zone enclosure 50 interior and mixes with cold ambient air that enters the exit end opening 53 as infiltration air, thus heating the infiltration air and, upon mixing with enclosure atmosphere, raising the average air temperature throughout the conditioning zone enclosure 50. A higher air temperature allows for more vapor to be absorbed, thereby reducing the likelihood of condensation. In this way, the operator of the equipment can strike an optimal balance between providing cooling air for cooling the web, and adding just enough heat to prevent condensation from forming. Alternatively, a heater such as electric heater 140 can be provided to heat any infiltration air that may enter the conditioning zone 50 through the web exit slot 53. The heater 140 can also control the air temperature in the conditioning zone 50.

Figure 4:
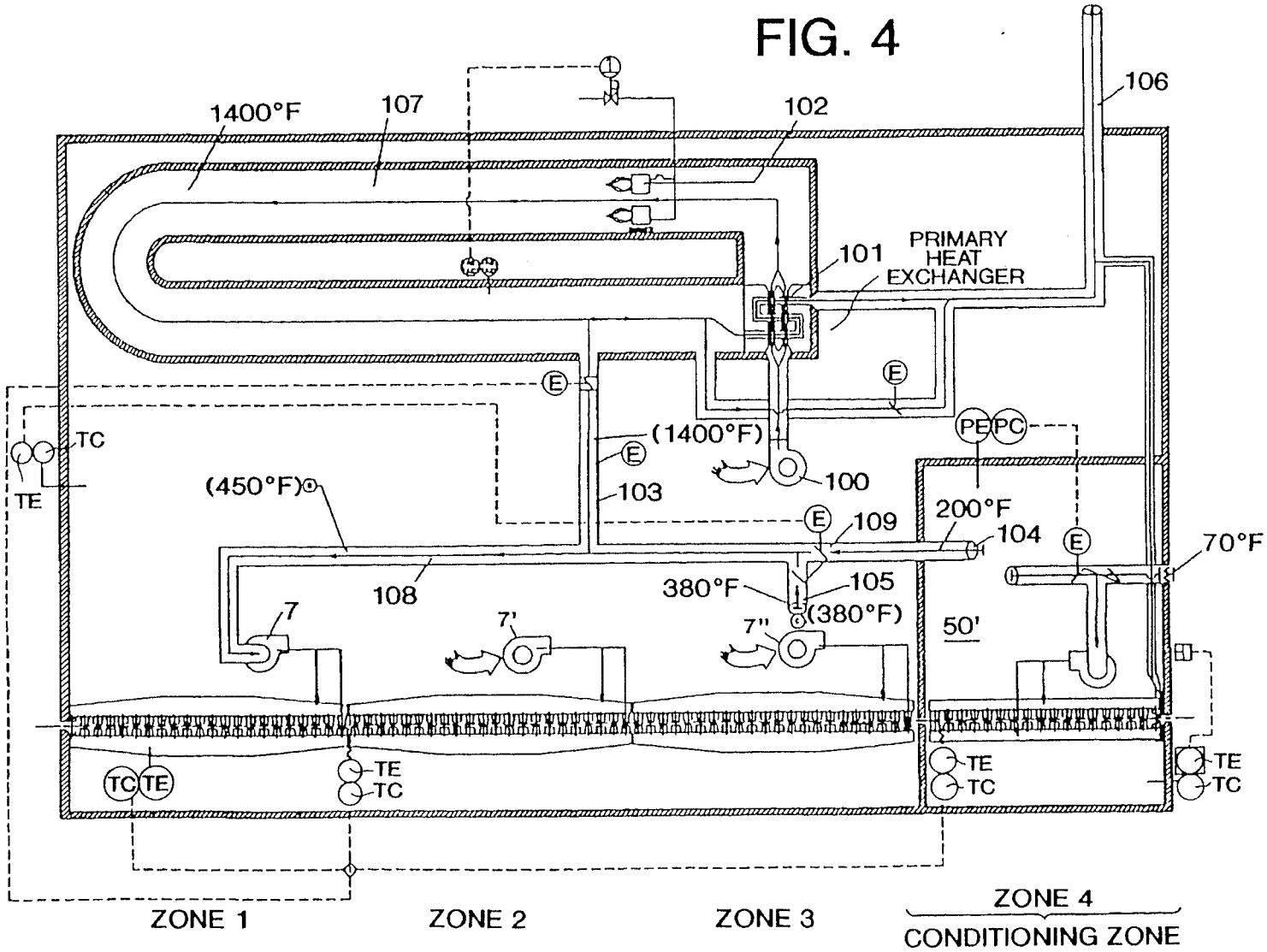
FIG. 4 is a schematic representation of a dryer including an integrated oxidizer in accordance with a further embodiment of the present invention.

Turning now to FIG. 4, there is shown a dryer including an integrated oxidizer and a conditioning zone 50'. Exhaust air is drawn from the leaving end or last zone of the heating dryer via a fan 100. This exhaust air is pre-heated by a heat exchanger 101, and is then heated to oxidation temperature (approximately 1400° F.) by one or more burners 102. The heated air, now at a temperature sufficient to fully oxidize the volatiles to innocuous products and thus clean air, enters a combustion chamber 107 for further mixing and for a sufficient time to complete the reaction. A small portion of the resulting hot, clean air leaves the chamber 107 through duct 103 and is mixed with a combination of conditioning zone 50' air (at approximately 200° F.) from duct 104 and dryer atmosphere air (at approximately 380° F.) from duct 105. The resulting gas mixture having a temperature of approximately 450° F. is transported to the first, or entering zone 1 via mixing duct 108. The remaining hot, clean air is passed through the heat exchanger 101, where it pre-heats exhaust gases, and is vented to atmosphere through duct 106.

The control of the make-up air through duct 104 and dryer atmosphere air through duct 105 may be accomplished by a damper 109, which, for example, controls both flows simultaneously either interconnectedly or by separate controls. Thus, when the damper part of duct 104 opens to allow more flow, the damper part of duct 105 closes to equally decrease the mass flow rate through duct 105. Additionally, a fan may be connected directly to duct 104 which in concert with a make-up air damper on the inlet side of the fan, or in concert with a variable speed drive, may draw air from conditioning zone 50' and force it controllably into the heating dryer. The flow patterns within the dryer are then identical to those for the dryer of the first embodiment discussed above.

What is claimed is:

1. Apparatus for drying a web of material having a coating containing volatile substances, comprising:

a dryer enclosure having a web inlet opening and a web exit opening spaced from said web inlet opening, said dryer enclosure including at least a first drying zone having a first drying zone atmosphere and a leaving drying zone having a leaving drying zone atmosphere;

a plurality of air jet nozzles in each of said drying zones for blowing air onto said web;

a burner in said dryer enclosure, said burner being in communication with air from outside said dryer enclosure; and recirculation means in communication with said burner for recirculating a mixture of leaving drying zone atmosphere and said air from outside said dryer enclosure to said first zone of said dryer, said recirculation means comprising a duct in communication with said burner and a supply fan operative to move a mixture of leaving drying zone atmosphere and outside air to said first dryer zone.

2. The apparatus of claim 1, further comprising exhaust means for exhausting leaving drying zone atmosphere from said dryer enclosure.

3. The apparatus of claim 1, further comprising at least one additional drying zone.

4. The apparatus of claim 1, further comprising pressure sensing means in said dryer enclosure for sensing the pressure therein, and means responsive to said pressure sensing means for regulating the amount of said air from outside said dryer enclosure flowing through the flame of said burner.

5. The apparatus of claim 1, wherein a portion of said air from outside said dryer enclosure supplies oxygen necessary to support the flame of said burner.

6. The apparatus of claim 1, further comprising a conditioning zone enclosure having a web inlet side and a web exit side spaced from said web inlet side, said web inlet side having a web inlet opening, and said web outlet side having a web outlet opening;

a plurality of air jet nozzles in said conditioning zone for blowing air onto said web;

pressure sensing means in said conditioning zone for sensing pressure therein; and means responsive to said pressure sensing means for controlling the pressure in said conditioning zone by regulating the amount of ambient air entering said conditioning zone.

7. The apparatus of claim 6, further comprising conditioning zone side opposed gas seal nozzles positioned in said conditioning zone adjacent to said web inlet opening, said conditioning zone side opposed gas seal nozzles being sealed to said web inlet side of said conditioning zone, said conditioning zone side opposed gas seal nozzles blowing air in said conditioning zone in a direction counter to the direction of travel of said web.

8. The apparatus of claim 7, wherein said dryer enclosure is separated from said conditioning zone enclosure by a wall in which said web inlet opening is formed, said web inlet opening having a dryer enclosure side and a conditioning zone enclosure side, said apparatus further comprising dryer side opposed gas seal nozzles positioned in said dryer enclosure adjacent to said web inlet opening, said dryer side opposed gas seal nozzles being sealed to said dryer enclosure side of said web inlet opening, said dryer side opposed gas seal nozzles blowing air in said dryer in a direction counter to the direction of travel of said web.

9. The apparatus of claim 6, wherein said means responsive to said pressure sensing means comprises a control valve positioned in a duct in air receiving communication with said ambient air.

10. The apparatus of claim 6, wherein said air from outside said enclosure is conditioning zone atmosphere air.

11. Apparatus for drying a web of material having a coating containing volatile substances, comprising:

a dryer enclosure having a web inlet opening and a web exit opening spaced from said web inlet opening, said dryer enclosure including at least a first drying zone having a first drying zone atmosphere and a leaving drying zone having a leaving drying zone atmosphere;

a plurality of air jet nozzles in each of said drying zones for blowing air onto said web;

a burner in said dryer enclosure for oxidizing volatives in said leaving drying zone atmosphere;

recirculation means in communication with said burner for recirculating a mixture of oxidized leaving drying zone atmosphere, unoxidized leaving zone dryer atmosphere and air from outside said dryer enclosure to said first zone of said dryer;

a conditioning zone enclosure having a web inlet side and a web exit side spaced from said web inlet side, said web inlet side having a web inlet opening, and said web outlet side having a web outlet opening;

a plurality of air jet nozzles in said conditioning zone for blowing air onto said web;

pressure sensing means in said conditioning zone for sensing pressure therein; and means responsive to said pressure sensing means for controlling the pressure in said conditioning zone by regulating the amount of ambient air entering said conditioning zone.

12. The apparatus of claim 11, further comprising exhaust means for exhausting leaving drying zone atmosphere from said dryer enclosure.

13. The apparatus of claim 11, further comprising at least one additional drying zone in said dryer enclosure.

14. The apparatus of claim 11 wherein said air from outside said dryer enclosure is conditioning zone atmosphere air.

15. The apparatus of claim 11, further comprising conditioning zone side opposed gas seal nozzles positioned in said conditioning zone adjacent to said web inlet opening, said conditioning zone side opposed gas seal nozzles being sealed to said web inlet side of said conditioning zone, said conditioning zone side opposed to gas seal nozzles blowing air in said conditioning zone in a direction counter to the direction of travel of said web.

16. The apparatus of claim 15, wherein said dryer enclosure is separated from said conditioning zone enclosure by a wall in which said web inlet opening is formed, said web inlet opening having a dryer enclosure side and a conditioning zone enclosure side, said apparatus further comprising dryer side opposed gas seal nozzles positioned in said dryer enclosure adjacent to said web inlet opening, said dryer side opposed gas seal nozzles being sealed to said dryer enclosure side of said web inlet opening, said dryer side opposed gas seal nozzles blowing air in said dryer in a direction counter to the direction of travel of said web.

17. The apparatus of claim 11, wherein said means responsive to said pressure sensing means comprises a control valve positioned in a duct in air receiving communication with said ambient air.

* * * * *